US005445689A

United States Patent [19]

Kornely

[11] Patent Number: 5,445,689

[45] Date of Patent: Aug. 29, 1995

[54] PULSED ION BEAM SURFACE TREATMENT PROCESS FOR ALUMINUM HONEYCOMB PANELS TO IMPROVE CORROSION RESISTANCE

[75] Inventor: Michael G. Kornely, Centerport, N.Y.

[73] Assignee: Northrop Grumman Corporation, Los Angeles, Calif.

[21] Appl. No.: 294,506

[22] Filed: Aug. 23, 1994

[51] Int. Cl.[6] ..... C22F 1/00; C22F 1/04

[52] U.S. Cl. ..... 148/565; 29/6.1; 156/197; 428/528

[58] Field of Search ..... 148/565; 427/528; 29/6.1, 17.1, 17.2, 17.3; 228/157; 156/197

[56] References Cited

U.S. PATENT DOCUMENTS

| | | | |
|---|---|---|---|
| 3,365,787 | 1/1968 | Forsberg et al. | 29/471.1 |
| 3,915,757 | 10/1975 | Engel . | |
| 4,021,592 | 5/1977 | Fromson | 428/209 |
| 4,124,802 | 11/1978 | Terasawa et al. | 250/492 A |
| 4,509,254 | 4/1985 | Damrow et al. | 29/623.5 |
| 4,683,149 | 7/1987 | Suzuki et al. | 204/192.31 |
| 4,893,743 | 1/1990 | Eylon et al. | 228/181 |
| 4,894,127 | 1/1990 | Wong et al. | 204/58.5 |
| 4,986,871 | 1/1991 | Leslie | 156/494 |
| 5,007,225 | 4/1991 | Teasdale | 52/799 |
| 5,024,369 | 6/1991 | Froes et al. | 228/157 |
| 5,055,318 | 10/1991 | Deutchman et al. | 427/309 |
| 5,224,249 | 7/1993 | Kornely, Jr. | 29/6.1 |

FOREIGN PATENT DOCUMENTS

| | | |
|---|---|---|
| 269112A | 11/1986 | European Pat. Off. . |
| 3931565C | 9/1989 | Germany . |
| 50-70278 | 6/1975 | Japan . |
| 55-31150 | 8/1978 | Japan . |
| 59-47380 | 9/1982 | Japan . |
| 62-174377 | 1/1986 | Japan . |
| 1486538A | 1/1987 | U.S.S.R. . |

*Primary Examiner*—John Sheehan

*Attorney, Agent, or Firm*—Terry J. Anderson; Karl J. Hoch, Jr.

[57] ABSTRACT

A method for improving the corrosion and wear resistance properties of aluminum honeycomb core panel construction is disclosed. In a first embodiment, a surface of an aluminum honeycomb metal specimen is melted using a pulsed ion beam and then left to cool by thermal diffusion. A layer of metallic glass demonstrating enhanced hardness and corrosion resistance properties formed integrally with the specimen surface results. In a second embodiment, the surface of the aluminum honeycomb metal specimen is coated with a thin film of metal material. Ions in the pulsed beam drive the atoms in the metal film into the near-surface region of the aluminum honeycomb metal specimen to create an alloy which also has enhanced corrosion and wear properties.

12 Claims, 1 Drawing Sheet

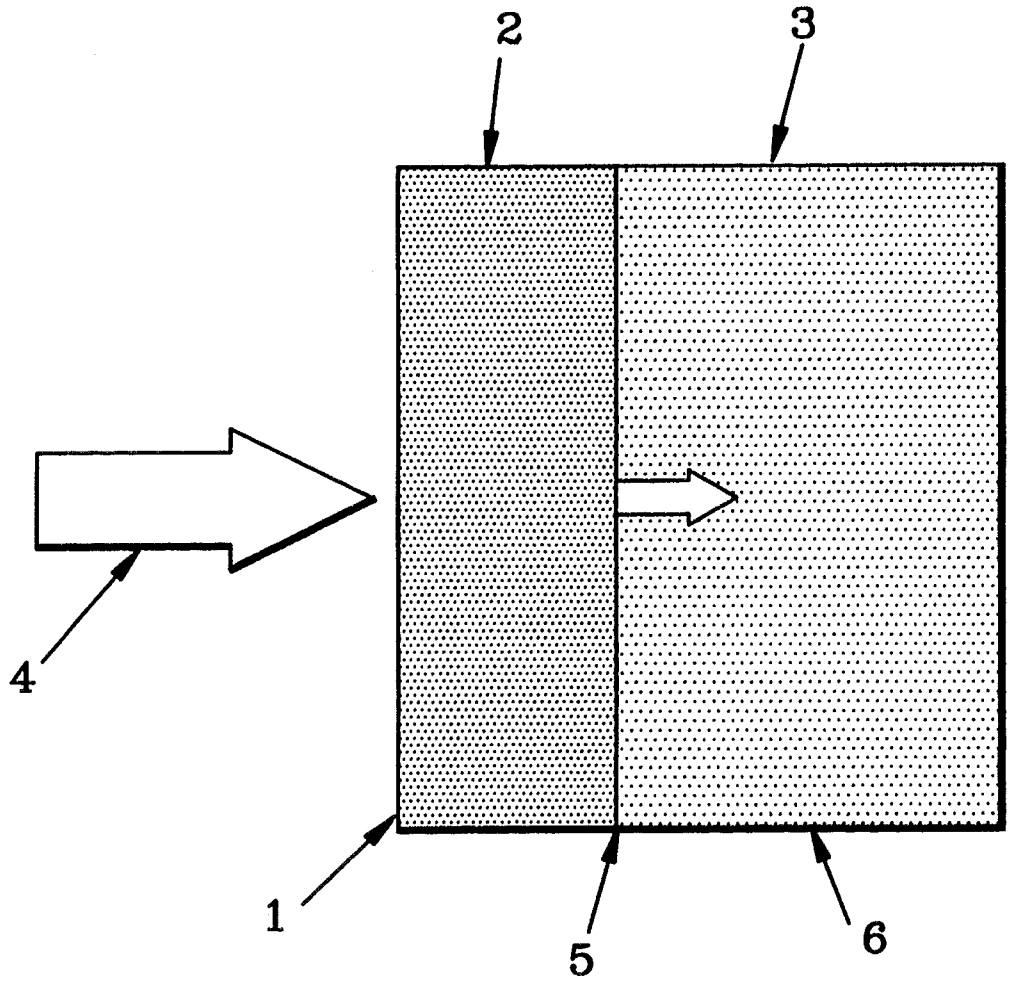
4
1
2
5
3
6

PULSED ION BEAM SURFACE TREATMENT PROCESS FOR ALUMINUM HONEYCOMB PANELS TO IMPROVE CORROSION RESISTANCE

BACKGROUND OF THE INVENTION

1. Field of the Invention

This invention generally relates to improving the corrosion and wear resistance of aluminum honeycomb core panel construction by modifying the surface composition and properties of sheet material used to fabricate this type of construction.

2. Description of the Related Art

The use of ion beams to modify the near-surface physical and chemical properties of metals to improve their corrosion and wear resistance is well known. U.S. Pat. No. 5,224,249, for example, discloses an ion implantation process for increasing the corrosion resistance of honeycomb core panel construction used in the fabrication of aircraft wings, fuselage, and other structural framework. During this process, sheet metal used to construct the core and outer skin layers of the honeycomb core panel construction is bombarded with a high-intensity beam of metallic ions. These ions strike the surface of the sheet metal and become embedded therein to a predetermined depth. Atoms of the sheet metal intermix with the metallic ions to create a surface alloy having enhanced corrosion and wear resistance properties. U.S. Pat. No. 4,743,308 discloses a similar process for conditioning the surface of titanium parts used in the construction of human body joint implants.

Conventional ion implantation techniques have a number of drawbacks. First, the high-intensity beam of metallic ions conventionally needed to implement the ion implantation process is difficult to generate and maintain for any significant length of time. Treating a metal workpiece of any significant size therefore becomes a time consuming task. Second, developing an ion beam made of metallic ions, as opposed to non-metallic ions such as the ions from a gas, is expensive. For at least these two reasons, ion implantation as a means of enhancing the corrosion and wear resistance properties of metals is impractical for use in an industrial setting where cost and high volume production are of paramount importance.

The discovery of cheaper, more efficient techniques for increasing the corrosion and wear resistance of metals, and especially aluminum metals used to fabricate honeycomb core panel construction, continues to be an important concern. Existing techniques such as ion implantation have proven to be inadequate in terms of cost and ability to meet mass production demands. A need therefore exists for a process for improving the corrosion and wear resistance properties of aluminum honeycomb metals which is economical to implement and able to meet the high volume production demands of industry.

SUMMARY OF THE INVENTION

It is a principal objective of the present invention to provide an improved process for strengthening the corrosion and wear resistance properties of aluminum honeycomb metals which is faster and more economically efficient compared with known surface enhancement techniques.

It is second objective of the present invention to provide an improved process for strengthening the corrosion and wear resistance properties of aluminum honeycomb metals by using a pulsed beam of non-metallic ions which can more easily achieve the high beam intensities required to effectively increase corrosion and wear resistance compared with metallic ion beams.

It is another objective of the present invention to provide a process which increases the hardness and corrosion resistance of aluminum honeycomb metals by transforming, using solely thermal techniques, the near-surface region of a metal into a layer of metallic glass.

It is another objective of the present invention to provide a process for strengthening the corrosion and wear resistance properties of aluminum honeycomb metals which can be implemented at a reduced cost compared with known methods by using a gas ion beam which can be generated using a commercially-available, long-life ion source.

It is another objective of the present invention to provide an improved process for increasing the corrosion and wear resistance of aluminum honeycomb core panel construction which, over time, will achieve the benefit of a substantial reduction in life cycle material costs by eliminating the need for rebuilding or replacing vital aircraft control surfaces.

It is a another objective of the present invention to provide a process for improving the corrosion and wear resistance properties of aluminum honeycomb metals without increasing the original dimensions or weight of the metal.

It is another objective of the present invention to provide a process for cleaning the surface of an aluminum honeycomb metal specimen without requiring the use of solvents.

The foregoing and other objectives of the invention are achieved by providing a process which uses repetitive pulsed power and ion beam technologies to improve the corrosion and wear resistance of aluminum metals used to fabricate honeycomb core panel construction. A first embodiment of the process involves melting the near-surface region of a metal specimen to a predetermined depth using a high-intensity, pulsed beam of gas ions. The near-surface region is then rapidly cooled by thermal diffusion, leaving an integral surface layer of metallic glasses and fine grains having increased hardness and corrosion resistance properties.

The second embodiment of the process incorporates the formation of a surface alloy into the rapid melt-/cooldown technique of the first embodiment. A preliminary step of this embodiment is the application of a thin coating of a preselected metal on the surface of an aluminum metal specimen to be treated. The coated metal surface is then melted using a pulsed beam of gas ions as before. During this melting phase, ions from the beam drive atoms in the metal coating into the near-surface region of the specimen. The specimen is then permitted to cool by thermal diffusion to form a surface alloy which demonstrates corrosion resistance and wear properties superior to known techniques.

Both embodiments of the process may be used to improve the corrosion and wear resistance properties of honeycomb core construction panel made from aluminum or one of its alloys.

BRIEF DESCRIPTION OF THE DRAWINGS

The FIGURE is a diagram illustrating the melt and cooldown steps included in a first embodiment of the surface treatment process of the present invention.

DESCRIPTION OF THE PREFERRED EMBODIMENTS

The surface treatment process of the present invention uses repetitive pulsed power and ion beam technologies to alter, in a controlled manner, the physical and chemical composition of solid materials, and more particularly to clean, harden, alloy, and improve the corrosion and wear resistance properties of aluminum honeycomb metals to be used, for example, in the fabrication of frameworks and supports.

A first preferred embodiment of the surface treatment process of the present invention relies solely on thermal techniques to improve the corrosion and wear resistance of aluminum metal used in the fabrication of honeycomb core panel construction. Referring to the FIGURE, a first step of the process involves rapidly melting a surface 1 and near-surface region 2 of an aluminum metal specimen 3 using a high-energy, pulsed ion beam 4 (represented as the large arrow in the FIGURE).

Use of a pulsed ion beam to melt the specimen surface is desirable because virtually all of the beam energy is confined within the specimen surface. The depth to which the ions penetrate into the specimen surface, called the ion range and represented as numeral 5 in the FIGURE, is a function of the ion species used and the energy initially imparted to those ions as they are fired towards the specimen surface. The depth of the ion range may be as great as the length of one ion. The ion species used to create the beam is preferably ions of a gas such as hydrogen, argon, and nitrogen, however other species may be used.

The melting step of the process of the present invention may, in the alternative, be accomplished using a laser or electron beam.

The second step of the process involves allowing the melted surface of the specimen to cool down. Cooling occurs at a rapid rate and is accomplished by thermal diffusion into the unheated portions 6 of the metal specimen.

The result of this process is to produce a metal specimen having an amorphous surface made of metallic glasses and fine grains which demonstrate enhanced corrosion resistance and hardness properties. The increased hardness of the specimen increases the wear and fatigue resistance of the metal making it better able to withstand friction and other external forces. All of these enhancements in combination significantly increase the useful life of aluminum honeycomb metal and the objects which are manufactured from such metals.

EXAMPLE

During laboratory experiments, Applicants scanned a surface of a sheet of aluminum with a hydrogen ion beam having a beam energy of between 0.5 and 1 MeV protons and an energy deposition level of between 2 and 8 J/cm$^2$. The generator used to produce the ion beam was a repetitively-pulsed, plasma, anode-based ion beam system powered by a pulsed power system operating at 0.9 MV, 25 kA, 1250 J, 120 Hz, and 50% electrical efficiency. The hydrogen ion beam penetrated the near-surface region of the specimen to a ion range of from 3 to 7 microns. Cooling by thermal diffusion occurred at a rate of between $10^8$ and $10^{10}$ K/sec.

Using the experimental values mentioned above, Applicants were able to achieve a production rate greater than 1 m$^2$/sec or 7 m$^2$/min, a rate much faster than existing techniques which use ion beams to enhance the corrosion resistance of metals.

A second embodiment of the surface treatment process of the present invention improves the corrosion resistance and hardness properties of metals by incorporating a surface alloy formation step into the thermal technique previously described. The initial step of this embodiment involves the application of one or more thin coatings of a predetermined metal (e.g., chromium, tantalum, molybdenum, etc.) on the surface of a metal specimen. The coated metal surface is then scanned with a high-intensity, pulsed beam of gas ions which drive atoms in the metal coating into the near-surface region of the metal specimen. Atoms of the metal specimen and metal coating intermix within the ion range as the surface of the specimen melts. The near-surface region then cools by thermal diffusion leaving an alloy having a corrosion and wear resistance greater than that produced by the purely thermal technique of the first embodiment.

The first and second embodiments of the surface treatment process of the present invention may be used to improve the corrosion and wear resistance properties of aluminum or aluminum alloy sheet metal used to fabricate honeycomb core panel construction. Honeycomb core panel construction consists of two outer skin layers that are bonded to either side of a honeycomb-shaped core constructed from a plurality of interconnected hexagonal cells. The structure and uses of honeycomb core panel construction are discussed in greater detail in U.S. Pat. No. 5,224,249.

Application of the treatment process of the first embodiment involves directing a pulsed beam of gas ions towards one or both surfaces of sheet metal to be used to fabricate the honeycomb core. Ions from the beam penetrate into the metal to a predetermined depth so as to form an alloy which is impervious to corrosion. The treated sheet metal may then be deformed into a honeycomb-shaped structure using known techniques, such as the corrugation or expansion processes disclosed in U.S. Pat. No. 5,224,249. If desired, the same process may be applied to one or both surfaces of sheet metal used to form the outer skin layers of the honeycomb core panel construction.

Application of the treatment process of the second embodiment involves applying one or multiple thin coatings of a predetermined metal (e.g., chromium, tantalum, molybdenum, etc.) on one or both surfaces of sheet metal prior to exposure to the pulsed ion beam. The treated sheet metal may then be deformed into a honeycomb core using one of the previously-identified processes, or cut to form the outer skin layers of the panel construction.

The process of the present invention also may be used to increase the corrosion resistance of other structures made from aluminum and aluminum alloy sheet, such as shelves, bulkheads and floors, as well as other metals.

The surface treatment process of the present invention achieves a number of advantages which cannot be realized by known surface treatment methods. First, the use of a gas ion beam is advantageous because it enables the process of the present invention to generate high beam intensities more simply and for longer periods of time compared with existing processes which use metallic ion beams. This translates into an ability to mass produce surface treated metals at low cost.

Second, the enhanced corrosion and wear resistant properties achieved using the second embodiment of the process of the present invention is superior to any which can be produced using known ion-beam-based methods. This is mainly achieved through the use of a pulsed gas ion beam which, as discussed above, is longer-lasting compared with known metallic ion beams. This longer-lasting beam ensures that a greater degree of intermixing will occur between the atoms of the metal coating and the near-surface atoms of the metal specimen. As a result, a surface alloy having a greater concentration of metallic atoms is formed which is better able to withstand oxidation, fatigue, shock, friction, and other external forces which contribute to the wear of the metal.

Third, the use of a pulsed ion beam enables the process of the present invention to achieve favorable electrical efficiency characteristics compared with known processes which use laser, electron, and non-pulsed ion beams.

Applicants contemplate that both embodiments of the surface treatment process of the present invention may be used to clean, harden, and improve the corrosion and wear resistance properties of non-metallic solid materials such as ceramics.

Other modifications and variations to the invention will be apparent to those skilled in the art from the foregoing disclosure. Thus, while only certain embodiments of the invention have been specifically described herein, it will be apparent that numerous modifications may be made thereto without departing from the spirit and scope of the invention.

What is claimed is:

1. A process for increasing the corrosion resistance and hardness of honeycomb core panel construction, said construction having two outer skin layers bonded to opposite sides of a honeycomb-shaped core, the process comprising the steps of:

providing a core metal for a honeycomb-shaped core which is fabricated from a metal of aluminum or one of its alloys;

then melting at least one surface of said core metal using a pulsed ion beam, said melting producing a layer of metallic glass on the surface of said metal having increased hardness and corrosion resistance properties; and then deforming said core metal into a honeycomb-shaped structure so as to form the honeycomb-shaped core.

2. The process recited in claim 1, further comprising the step of:

coating the surface of said core metal with a metal, the ions in said beam driving atoms within said coating into the surface of said core metal during melting to form an alloy which contributes to the increased hardness and corrosion resistance properties of said core metal.

3. The process as specified in claim 1, further comprising the steps of:

providing aluminum sheet for the two outer skin layers; and melting at least one surface of said sheet metal using a pulsed ion beam, said melting producing a layer of metallic glass on said at least one surface of said sheet metal having increased hardness and corrosion resistance properties.

4. The process recited in claim 3, further comprising the step of:

coating the surface of said aluminum sheet with a metal, the ions in said beam driving atoms within said coating into the surface of said sheet metal during melting to form an alloy which contributes to the increased hardness and corrosion resistance properties of said sheet metal.

5. The process recited in claim 3, wherein said aluminum sheet is made from an alloy of aluminum.

6. The process recited in claim 2, wherein said metal coating is one selected from a group consisting of chromium, tantalum, and molybdenum.

7. The process recited in claim 4, wherein said metal coating is one selected from a group consisting of chromium, tantalum, and molybdenum.

8. The process recited in claim 1, where said pulsed ion beam is constructed from gas ions.

9. The process recited in claim 3, wherein said pulsed ion beam is constructed from gas ions.

10. The process recited in claim 1, wherein said beam penetrates into the surface of said core metal to a depth of one ion.

11. The process as specified in claim 1, wherein said core metal is deformed by using either a corrugation process or an expansion process.

12. The process as specified in claim 1, wherein front and back surfaces of said honeycomb core is melted by said pulsed ion beam.

* * * * *